US005452591A

United States Patent [19]

King

[11] Patent Number: 5,452,591

[45] Date of Patent: Sep. 26, 1995

[54] KNITTED BAND WITH INTEGRATED DRAWCORD AND METHOD OF FABRICATING SAME

[75] Inventor: Claude T. King, Burlington, N.C.

[73] Assignee: Southern Webbing Mills, Incorporated, Charlotte, N.C.

[21] Appl. No.: 198,952

[22] Filed: Feb. 18, 1994

[51] Int. Cl.[6] ..... D04B 11/00; A41D 1/14

[52] U.S. Cl. ..... 66/83; 66/1 R; 66/85 R; 66/203; 66/61; 66/170; 66/192; 2/220; 2/221

[58] Field of Search ..... 66/80, 81, 82 R, 66/83, 84 R, 84 A, 85 R, 203, 170, 172 E, 1 R, 61, 192; 2/76, 236, 237, 220, 221, 243.1

[56] References Cited

U.S. PATENT DOCUMENTS

| | | | |
|---|---|---|---|
| Re. 33,586 | 5/1991 | Graff . | |
| 2,088,302 | 7/1937 | McKeever | 2/243.1 |
| 2,551,044 | 5/1951 | Ottinger et al. | 2/243.1 |
| 2,854,670 | 10/1958 | Waccash | 2/243.1 |
| 3,236,070 | 2/1966 | Clayton | 66/170 |
| 3,887,968 | 6/1975 | Lynam . | |
| 4,466,137 | 8/1984 | Caraghi | 2/237 |
| 4,477,928 | 10/1984 | Graff . | |
| 5,040,244 | 8/1991 | Tubbs . | |
| 5,186,779 | 2/1993 | Tubbs . | |
| 5,375,266 | 12/1994 | Crisco | 2/243.1 |

FOREIGN PATENT DOCUMENTS

| | | | |
|---|---|---|---|
| 9012137 | 10/1990 | WIPO | 66/83 |

OTHER PUBLICATIONS

Introducing EZ Cord publication (with sample) Asheboro Elastics Corp.

*Primary Examiner*—Clifford D. Crowder
*Assistant Examiner*—Larry D. Worrell, Jr.
*Attorney, Agent, or Firm*—Shefte, Pinckney & Sawyer

[57] ABSTRACT

An elastic band is fabricated with an integrated drawcord utilizing a crochet-type warp knitting machine by initially knitting a finished elastic band and, then, re-routing the finished band back through the knitting machine to a second knitting location at which fabric piercing needles are utilized to knit additional warp and filling yarns while a drawcord is simultaneously fed between the piercing needles to form a covering web over the drawcord defining a tunnel area between the covering web and the finished band in which the drawcord is captured.

12 Claims, 5 Drawing Sheets

KNITTED BAND WITH INTEGRATED DRAWCORD AND METHOD OF FABRICATING SAME

BACKGROUND OF THE INVENTION

The present invention relates generally to knitted articles and methods and, more particularly, to a knitted band, especially an elastic band, with an integrated drawcord suitable for use in apparel and the like, and to a knitting method by which the band may be fabricated.

Many items of wearing apparel incorporate an elasticized band encircling a body opening, such as the waist opening in a lower body garment, to insure a snug and secure fit. In many such articles, it is common to incorporate a drawstring or drawcord in conjunction with the elastic band to enable the wearer to obtain a tighter and more secure fit than accomplished by the elastic band alone.

Traditionally, the fabrication of an elasticized waistband or other elasticized garment opening with the addition of a drawcord has been accomplished by first sewing an elastic band into the waistband or other garment opening utilizing longitudinally extending sewn seams and then, as a separate manual step, threading a separate drawcord or drawstring through the tunnel area defined by the seams between the garment and the elastic band. Disadvantageously, this process can be labor intensive and expensive unless performed by an experienced skillful apparel maker.

One attempt to overcome these disadvantages is described in U.S. Pat. No. 4,477,928, subsequently reissued as U.S. Pat. No. Re. 33,586, disclosing the fabrication of a woven, knitted or braided elastic band with a pull cord being "embedded" in the band as part of the knitting, weaving or braiding process. Advantageously, the elastic band with embedded pull cord of this patent may simply be sewn into a garment in the same manner as with conventional plain elastic bands, thereby eliminating the conventional necessity of threading a drawcord through the garment's waistband area as a separate manual operation. One disadvantage of this product, however, is that it is commercially sold at a relative premium which offsets to a significant extent the labor and cost savings realized.

An alternative approach to fabricating a composite elastic band and drawcord product is described in U.S. Pat. Nos. 5,040,244 and 5,186,779. These patents contemplate the adhesion of a drawcord to one surface of a previously fabricated elastic band, utilizing an adhesive which will retain the drawcord in place along the length of the band until fabrication of the composite band into a garment but will release the drawcord from the band thereafter to function in the normal manner of a drawcord. The composite band/drawcord of these patents is marketed commercially under the trade name ZIP CORD. One difficulty of this product is that the releasable nature of the adhesive necessitates careful handling of the composite band prior to fabrication into a garment so that the drawcord does not become separated from, or shifted in its relative disposition to, the underlying band. Thus, the common practice of winding elastic bands into rolls or festoons has generally been avoided with this composite product to limit the risk of displacing the drawcord. Instead, this product has typically been prefabricated and shipped in the form of endless loops of discrete lengths for incorporation into a garment.

A more recent proposed alternative is a composite elastic band/draw cord product currently being offered by Asheboro Elastics Corp., of Asheboro, N.C., under the trade name EZ CORD, wherein a drawcord is sewn to a previously fabricated plain elastic band utilizing a common zig-zag sewing stitch as a separate sewing operation subsequent to the knitting or weaving of the elastic band. While the EZ CORD product can be sewn directly into a garment in the same manner as the above-described patented product without the necessity of threading a separate drawcord into the elasticized area of the garment, the necessity of performing a separate sewing operation necessitates an additional capital expense for sewing equipment, thereby increasing the manufacturing expense of the product, and additional care must be taken to avoid penetration of the drawcord itself with the sewing thread so that the drawcord remains free to move relative to the lengthwise extent of the elastic band.

SUMMARY OF THE INVENTION

It is accordingly an object of the present invention to provide an improvement over the composite elastic band and drawcord products of the prior art. Specifically, it is an object of the present invention to provide a novel method by which a drawcord can be integrated with a plain elastic band by means of knitting stitches, rather than sewing, performed on the same knitting machine and as a separate step in the same overall knitting process by which the plain elastic band is fabricated.

Briefly summarized, the method of the present invention is performed utilizing a flat knitting machine of the type having an elongate needle bed for carrying and unitarily reciprocating a series of knitting needles, e.g., a conventional crochet-type warp knitting machine. Basically, the method of the present invention initially involves the progressive knitting of a first set of yarns on a set of the knitting needles at a first knitting location along the needle bed to form an elongated finished plain knitted band. The finished plain band is then directed to travel in its longitudinal extent away from and then to return to the needle bed at a second knitting location along the needle bed. At such second knitting location, the finished band is repetitively pierced with a pair of spaced needles while a drawcord is fed longitudinally to the finished band between the spaced pair of needles and another yarn is knitted on the spaced pair of needles to form a covering over the drawcord which is stitched to the finished band laterally along opposite sides of the drawcord to capture the drawcord in a tunnel area defined between the covering and the finished band.

In the preferred embodiment, the initial knitting of the finished band involves feeding to the set of knitting needles at the first knitting location a set of warp yarns traveling longitudinally in side-by-side relation and a corresponding set of elastic yarns also traveling longitudinally in side-by-side relation while a pair of filling yarns are fed to the needles from opposing sides of the warp and elastic yarns in a direction transverse thereto. At the second knitting location, a pair of additional warp yarns are fed respectively to the spaced pair of piercing needles while a filling yarn is simultaneously fed transversely to each of the pair of piercing needles, thereby to cover and capture the drawcord.

DESCRIPTION OF THE PREFERRED EMBODIMENT

Figure 1:
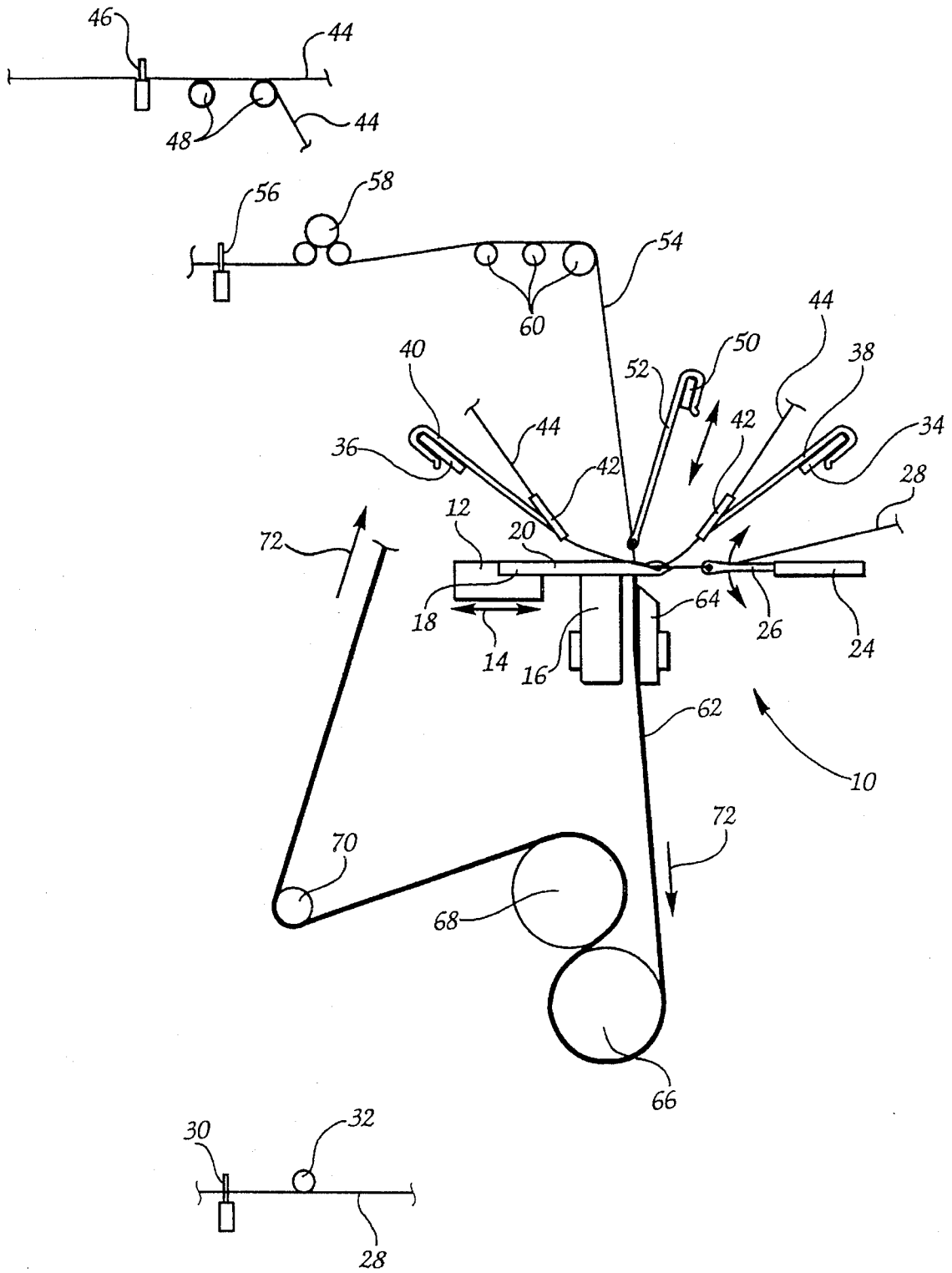
FIG. 1 is a schematic vertical cross-sectional view of a conventional crochet-type warp knitting machine as preferably modified and embodied for fabricating an elastic band with an integrated drawcord in accordance with the present invention, taken at the first knitting location along the needle bed of the machine at which the finished plain knitted band is initially fabricated.
Figure 2:
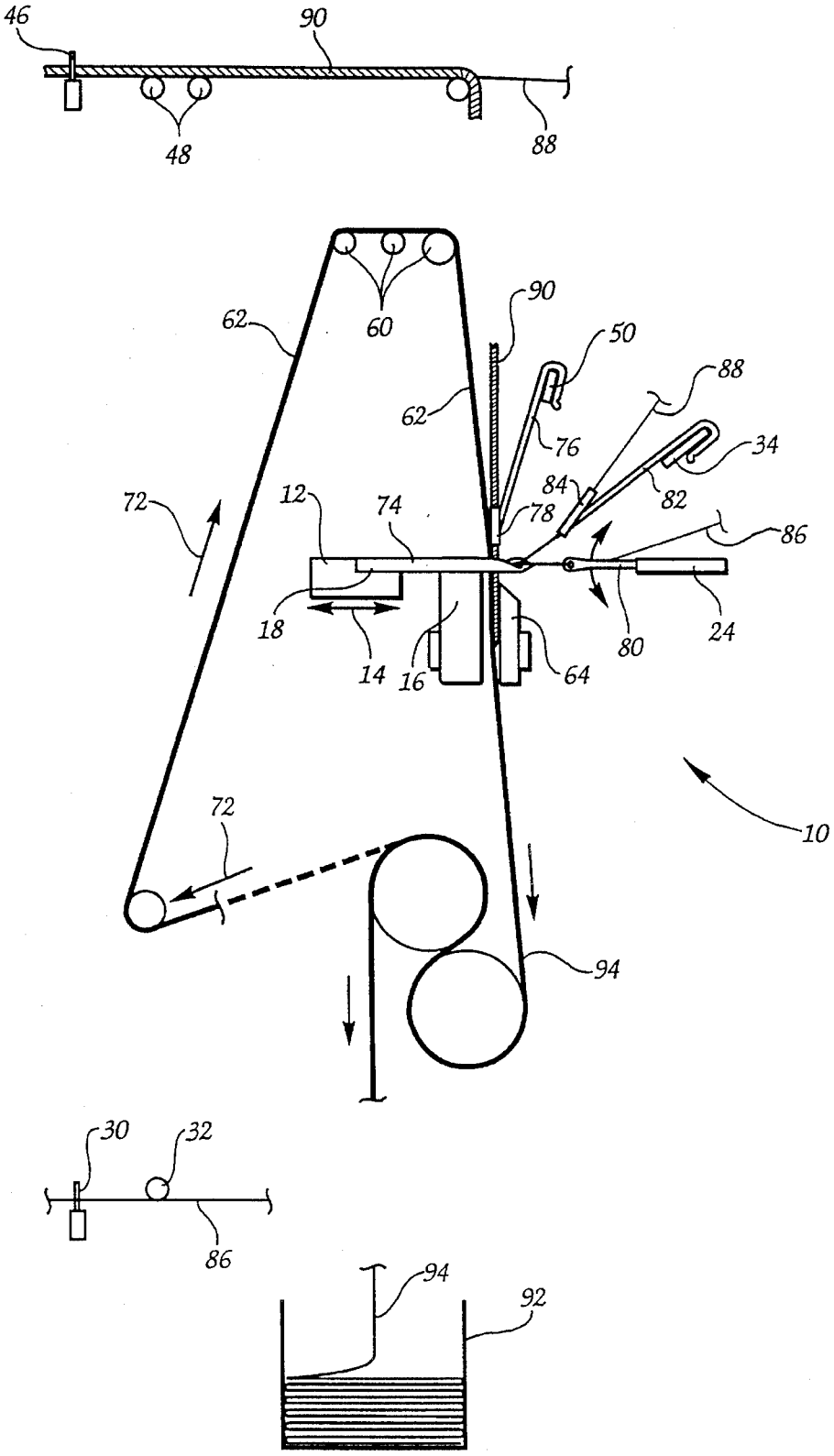
FIG. 2 is another schematic vertical cross-sectional view of the conventional crochet-type warp knitting machine of FIG. 1 as modified and embodied in accordance with the present invention, taken at the second knitting location along the needle bed at which the drawcord is integrated with the previously-knitted plain band by a subsequent knitting operation.
Figure 4:
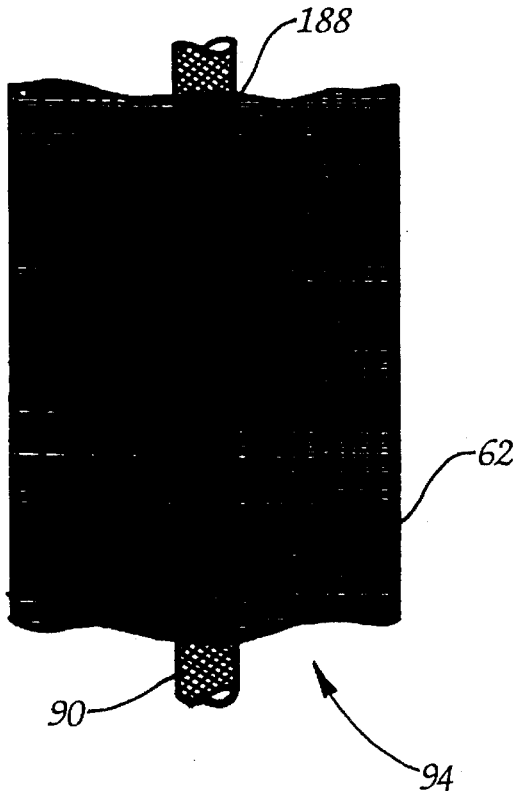
FIG. 4 is a schematic elevational view of the knitted structure of the elastic band with integrated drawcord produced in accordance with the present invention.
Figure 5:
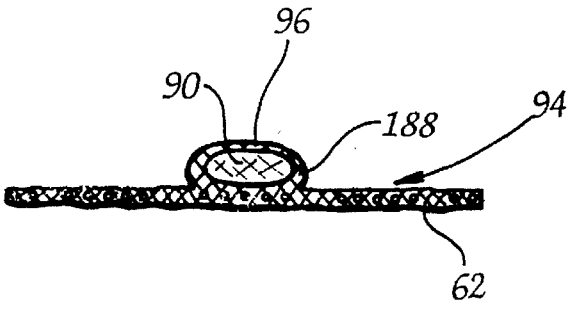
FIG. 5 is a schematic cross-sectional view of the elastic band of FIG. 4, taken along line 5—5 thereof.

Referring now to the accompanying drawings and initially to FIGS. 1 and 2, a conventional crochet-type warp knitting machine, such as manufactured by Comez S. P. A., of Cilavegna, Italy, is indicated generally at 10 as preferably modified and embodied for purposes of knitting the novel elastic band with integrated drawcord of the present invention, depicted in FIGS. 4 and 5 and more fully described hereinafter. Of course, however, those persons skilled in the textile knitting art will readily recognize that other forms of textile knitting machinery and knitting methods may be equally well employed for performing the method and knitting the band of the present invention. More specifically, it is contemplated that numerous other forms of warp or flatbed knitting machinery wherein knitting needles or other knitting instruments are unitarily carried and reciprocated by a common needle bed may be utilized to perform the present method to produce the present knitted band. Thus, the description of the method of the present invention herein as preferably performed utilizing a crochet-type warp knitting machine is to be understood as merely being for purposes of illustrating and describing an exemplary embodiment of the present invention and not to limit the scope and substance of the invention.

As depicted in FIGS. 1 and 2, the crochet-type knitting machine 10 is equipped with an elongate rear needle bed 12 supported widthwise across the machine frame (not shown) for forward and rearward reciprocation, as indicated by the directional arrow 14, relative to a stationary front needle bed 16 also disposed widthwise across the machine frame at a forward spacing from the rear needle bed 12. The rear needle bed 12 is formed with a plurality of needle slots 18 (FIGS. 3A and 3B) in which knitting needles 20, typically bearded needles, may be selectively fitted in side-by-side serial arrangement projecting forwardly from the rear needle bed 12 toward the front needle bed 16 for unitary reciprocatory knitting action relative to the front needle bed 16 integrally with forward and rearward reciprocations of the rear needle bed 12. To accommodate the reciprocating movements of the needles 20, the front needle bed 16 is formed with a series of needle slots 22 (FIGS. 3A and 3B) respectively aligned with the slots 18 in the rear needle bed 12.

The knitting machine 10 additionally includes several yarn guide bars supported widthwise across the machine frame adjacent the front needle bed 16 for individual reciprocatory knitting action relative to the needle bed 16 in synchronism with the reciprocations of the rear needle bed 12. Specifically, a warp yarn guide bar 24 is disposed forwardly of the front needle bed 16 and carries a series of warp yarn guide eyes 26 projecting rearwardly toward the needle bed 16, the guide eyes 26 corresponding in number and spaced arrangement to the needles 20 in the needle bed slots 18. A selected number of warp yarns 28 are fed in side-by-side parallel spaced relation from a yarn creel (not shown) through a comb 30 at the lower rear side of the knitting machine 10 and therefrom over a series of guide rods, only one of which is representatively indicated at 32, to the guide eyes 26 for feeding each individual warp yarn 28 to a respective needle 20 (see FIG. 3A).

A pair of filling yarn guide bars 34,36 are disposed to extend widthwise across the machine above the front needle bed 16 respectively at forward and rearward sides thereof. Each guide bar 34,36 carries a respective yarn guide element 38,40 extending from the guide bar at a downward angle toward the needle bed 16 and terminating in a tubular yarn guide sleeve 42. A pair of filling yarns 44 are fed from the machine creel through another yarn comb 46 disposed at the upper rear of the knitting machine 10 and therefrom over a series of guide rods, representatively indicated at 48, to and through the respective guide sleeves 42 of the front and rear filling yarn guide elements 38,40, for delivery to the knitting needles 20 simultaneously with the warp yarns 28.

An elastic yarn guide bar 50 is disposed directly above and slightly forwardly of the front needle bed 16 and carries a series of elastic yarn guide eyelets 52 extending downwardly toward the needle bed 16, the guide eyelets 52 corresponding in number and spaced arrangement to the needles 20 and the warp yarn guide eyes 26. A series of elastic yarns 54 are fed to the rear side of the knitting machine in parallel side-by-side relation through another yarn comb 56 and therefrom over a series of tensioning guide rollers 58 and guide rods 60 downwardly to the elastic yarn guide eyelets 52 from which each elastic yarn 54 is fed to a respective knitting needle 20 simultaneously with the warp yarns 28.

As previously indicated, each of the guide bars 24,34,36, 50 are supported on the frame of the knitting machine 10 by a conventional mechanical arrangement (not shown) including a patterning mechanism by which respective reciprocatory movements of the guide bars are controlled in timed synchronism relative to the forward-rearward reciprocations of the rear needle bed 12 to manipulate the respective yarns 28,44,54, with respect to the reciprocating needles 20 to effect, in conjunction with the reciprocating motion of the needles 20, a knitting action on the yarns to fabricate them progressively into an elongate knitted band of a conventional crochet-type knitted fabric structure of an extended indefinite length.

Figure 3A:
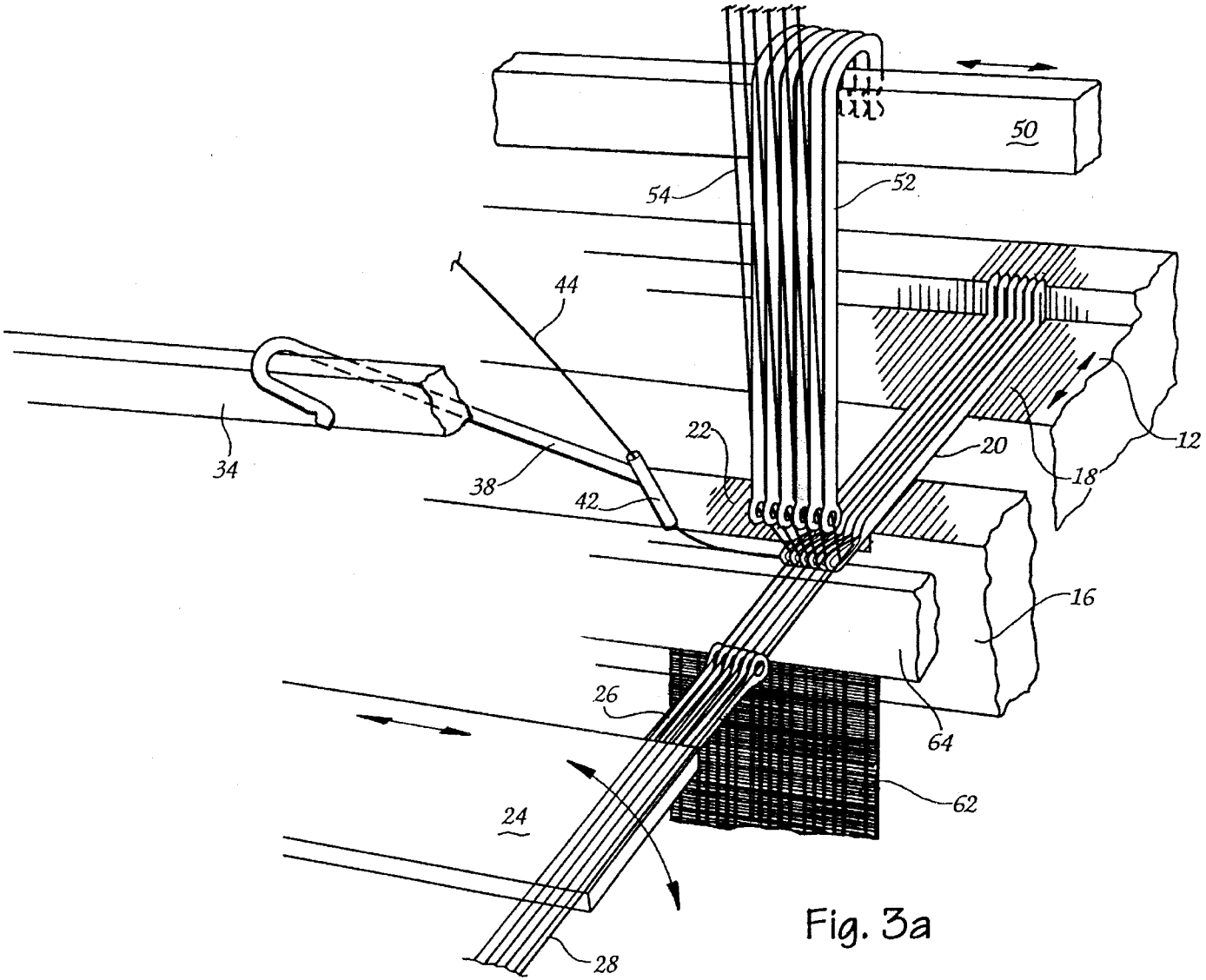
FIG. 3A is a schematic perspective view of the operative knitting instrumentalities and components at the first knitting location along the needle bed of the knitting machine of FIGS. 1 and 2.
Figure 3B:
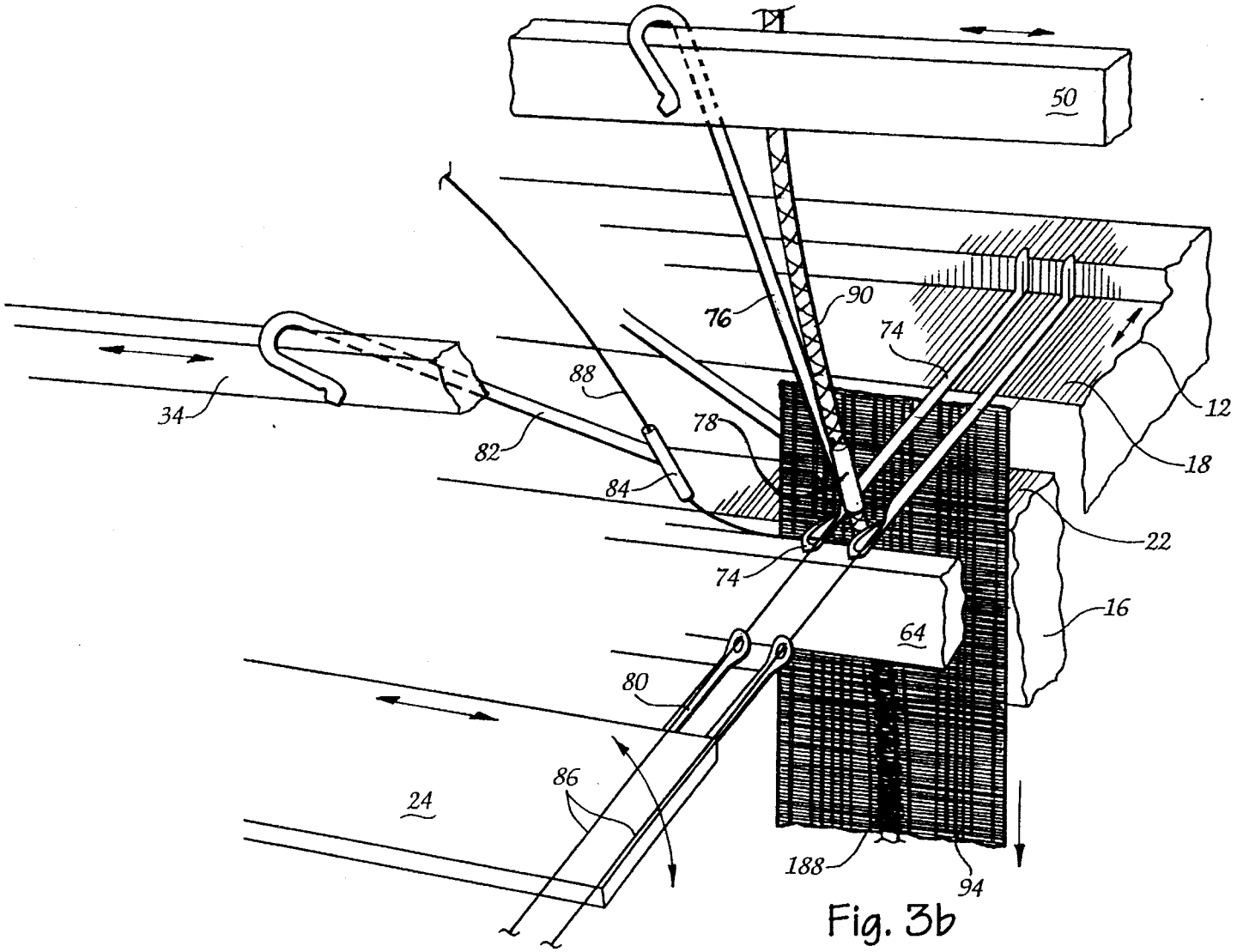
FIG. 3B is another schematic perspective view similar to FIG. 3A, of the operative knitting instrumentalities and components at the second knitting location along the needle bed of the knitting machine of FIGS. 1 and 2.

Specifically, the warp yarn guide bar 24, as indicated in FIGS. 1, 2 and 3A, reciprocates laterally from side-to-side relative to the frame of the knitting machine 10 as well as pivoting upwardly and downwardly, which effects a wrapping of the warp yarns 28 about the respective needles 20. The filling yarn guide bars 34,36 simultaneously reciprocate side-to-side of the knitting machine 10, as also indicated in FIG. 3A (wherein the rear filling yarn guide bar 36 has been omitted for clarity), to cause the respective filling yarn guide elements 38,40 to traverse back and forth laterally through a range of motion essentially corresponding to the number of serial needles 20 being utilized to knit the band of a given width, thereby to lay the filling yarns 44 laterally across all of the active needles 20 during each reciprocatory cycle of the rear needle bed 12. The elastic yarn guide bar 50 simultaneously reciprocates side-by-side, to feed the elastic yarns 54 to the respective needles 20. As this knitting operation progresses, the resultant knitted band 62 (FIGS. 1 and 3A) is drawn downwardly from the forward side of the front needle bed 16, between the needle bed 16 and a guide plate 64 mounted at a forward spacing therefrom, by a driven take-off mechanism, represented by the S-rolls 66,68.

As thus far described, the structure and operation of the warp knitting machine 10 is conventional. Typically, the warp knitting machine 10 is of a given predetermined width sufficient to enable a plurality of the knitted elastic bands 62 to be fabricated simultaneously on respective sets of knitting needles 20 arranged at spacings along the rear needle bed 12, with respective sets of warp yarn guide eyes 26, filling yarn guide elements 38,40, and elastic yarn guide eyelets 52 arranged at corresponding spacings along their respective guide bars 24, 34, 36, 50, with each individual finished plain knitted elastic band 62 being deposited from the driven take-off mechanism directly into respective collection boxes or other containers.

In contrast, however, the method of the present invention diverts the finished plain knitted elastic band 62 rearwardly from the S-rolls 66,68 to the rear of the knitting machine 10 and thereat rearwardly about and outwardly from a laterally-extending guide rod 70 to travel upwardly over the elastic yarn guide rods 60 and therefrom downwardly to another knitting location along the front needle bed 16 adjacent the previously described knitting location at which the band 62 was just fabricated. This path of travel of the knitted band 62 is indicated in FIGS. 1 and 2 by 10 the directional arrows 72 and, as shown, at the second knitting location along the needle bed 16, the band 62 passes between the forward side of the needle bed 16 and the guide plate 64. To insure that the travel of the band 62 remains consistently in the described path, the guide rod 70 is preferably angled rearwardly away from the machine frame to direct the band 62 to the adjacent second knitting location.

The rear needle bed 12 is equipped at this second knitting location with only a pair of knitting needles 74 in the form of so-called piercing needles, each having a taperingly pointed leading end adapted to penetrate and withdraw through the fabric of the knitted band 62 as a result of the forward-rearward reciprocations of the needle bed 12. No elastic yarns 54 are fed to the piercing needles 74 at the second knitting location but, rather, the elastic yarn guide bar 50 is equipped at this knitting location with a drawcord guide element 76 having an enlarged guide sleeve 78 at its downwardly projecting free end substantially adjacent the widthwise center of the knitted band 62. The piercing needles 74 are supported on the rear needle bed 12 at a lateral spacing sufficient to penetrate the elastic band 62 at opposite lateral sides of the drawcord guide element 76. In correspondence with the location and arrangement of the piercing needles 74, the warp yarn guide bar 24 is equipped at the second knitting station with only a pair of operative guide eyes 80 arranged at the same lateral spacing to one another as the piercing needles 74 to extend rearwardly in substantial alignment therewith. The forward filling yarn guide bar 34 is equipped at the second knitting location with a filling yarn guide element 82, substantially identical to the filling yarn guide element 38, extending downwardly and rearwardly to dispose its yarn guide sleeve 84 adjacent the front needle bed 16.

A pair of warp yarns 86 are fed from the creel through the yarn comb 30, about the guide rod 32, and through the pair of warp yarn guide eyes 80 respectively to the piercing needles 74. A single filling yarn 88 is fed from the creel through the yarn comb 46, over the guide rods 48 and through the guide sleeve 84 of the filling guide element 82 to the piercing needles 74. At the same time, a drawcord 90 is similarly fed through the comb 46, over the guide rods 48 and through the guide sleeve 78 of the drawcord guide element 76 downwardly between the front needle bed 16 and the guide plate 64 centrally along the forward face of the knitted band 62 between the piercing needles 74.

The respective reciprocatory motions of the needle bed 12, the warp yarn guide bar 24, and the filling yarn guide bar 34 manipulate the piercing needles 74, the warp yarn guide eyes 80, and the filling yarn guide element 82 relative to one another in the same fashion as above-described at the first knitting location, causing the filling yarn 88 to traverse laterally back and forth across the drawcord 90 as the band-penetrating and withdrawing reciprocations of the piercing needles 74 knit and anchor the warp yarns 86 and the filling yarns 88 in the fabric of the knitted band 62 along opposite sides of the drawcord 90. In this manner, the warp and filling yarns 86,88 form a tunnel area between the forwardly facing surface of the knitted band 62 and the web-like successive traversing extents of the filling yarn 88 in which the drawcord 90 is captured.

The composite band produced by thusly integrating the drawcord 90 with the knitted band 62 (collectively identified hereinafter as composite band 94) remains under lengthwise tension as it is withdrawn downwardly from the second knitting location by the S-rolls 66,68. As the composite band 94 passes the second S-roll 68, the lengthwise tension on the composite band 94 is relieved and the band 94 is directed into a suitable collection container, indicated only schematically at 92.

As those persons skilled in the art will understand, the elastic yarns 54 are held under a predetermined amount of longitudinal tension, and are thereby stretched, as they are fed to the first knitting location of FIGS. 1 and 3A along the front needle bed 16, while simultaneously the warp and filling yarns 82,44 are tensioned to a predetermined degree, whereby the finished knitted elastic band 62 will have a desired degree of lengthwise elasticity and stretchability after the knitting operation is completed and the tensioning is relieved to allow the band to relax. Under the present invention, the tension in the band 62 is maintained as it is directed from the first knitting location about the S-rolls 66,68 and therefrom to the second knitting location. Thus, as will be understood, as the composite knitted band 62 with the integrated drawcord 90 is withdrawn from the second knitting location about the S-rolls 66,68 and allowed to relax as the composite band 94 is deposited into the collection container 92, the lengthwise contraction of the band 62 acts to uniformly relax and compress the drawcord 90 along its length within the tunnel area between the filling yarns 88 and the band 62. Thus, when a length of the composite band 94 is subsequently sewn into a garment, a length of the drawcord 90 can be pulled outwardly from the composite band 94 between adjacent segments of the filling yarn 88, e.g., using a hook or other instrument to engage and withdraw the drawcord 90, thereby to expose the drawcord for its normal use.

The composite band 94 is depicted schematically in FIGS.

4 and 5. As will be seen, the plain elastic band 62 preliminarily knitted at the first knitting location along the front needle bed 16 forms a complete finished plain knitted elastic band in itself. In the composite band 94, the drawcord 90 is situated to extend lengthwise at one face of the finished plain band 62 at the widthwise center thereof, with successive transverse courses 188 of the filling yarn 88 collectively forming a web outwardly covering the drawcord 90 and being anchored at opposite sides thereof in the body of the band 62 by interknitting with the lengthwise-extending warp yarns 86. Thus, as aforementioned, the body of the plain band 62 and the filling yarn courses 188 define a tunnel area 96 extending lengthwise at one side of the band 62 within which the drawcord 90 is captured and retained. The drawcord 90 is substantially freely slidable within the tunnel area 96 to facilitate normal use of the drawcord 90 when a length of the composite band 94 is fabricated into a garment.

Advantageously, as will be understood, the composite elastic band with integrated drawcord is fabricated in accordance with the present invention on the same crochet-type warp knitting machine utilized for fabricating a plain knitted band, with the only necessary modifications being the differing arrangement of yarn feeding instruments on the machine's guide bars at the second knitting station and preferably also the angular orientation of the guide rod 70. In contrast to the elastic product with embedded drawcord of U.S. Pat. No. 4,477,928 (U.S. Pat. No. 33,586), it is not necessary to omit any elastic yarns from the main body of the elastic band 62, whereby the structural integrity of the band 62 is unaffected and the composite band 94 better simulates the traditional use of a separate elastic band with a threaded-in drawcord, which a number of apparel manufacturers continue to prefer over the product of such patent. In contrast to the EZ CORD product, the present invention does not necessitate the additional capital expense of providing zig-zag sewing machines or devices and it is believed that the knitting operation of the present invention will more reliably integrate the drawcord with the plain elastic band with a lessened risk of potentially stitching the drawcord to the underlying body of the band as well as potentially better control of the inlay of the cord in the completed composite band. As a further advantage over the ZIP CORD product, the composite band of the present invention does not suffer the risk of potential separation or shifting movement of the drawcord relative to the band prior to incorporation into a garment and, further, should additionally be less costly to manufacture.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method of fabricating a band with an integrated drawcord comprising the steps of a) providing a flat knitting machine of the type having an elongate needle bed for carrying and unitarily reciprocating a series of knitting needles, b) progressively knitting a first set of yarns on a set of the knitting needles at a first knitting location along the needle bed to form an elongate finished knitted band, c) directing the finished band to travel in its longitudinal extent away from and then to return to the needle bed at a second knitting location along the needle bed, and d) at the second knitting location, repetitively piercing the finished band with a pair of spaced needles while feeding a drawcord longitudinally to the finished band between the spaced pair of needles and knitting another yarn on the spaced pair of needles to form a covering over the drawcord stitched to the finished band laterally along opposite sides of the drawcord to capture the drawcord in a tunnel area defined between the covering and the finished band.

2. A method of fabricating a band with an integrated drawcord according to claim 1, wherein the step of knitting a first set of yarns comprises feeding a set of warp yarns in side-by-side relation to the set of knitting needles.

3. A method of fabricating a band with an integrated drawcord according to claim 2, wherein the step of feeding the set of warp yarns comprises feeding each warp yarn to a respective one of the set of knitting needles.

4. A method of fabricating a band with an integrated drawcord according to claim 3, wherein the step of knitting a first set of yarns comprises feeding at least one filling yarn to each needle of the set of knitting needles simultaneously with the set of warp yarns in a direction transverse to the warp yarns.

5. A method of fabricating a band with an integrated drawcord according to claim 4, wherein the step of knitting a first set of yarns comprises feeding a set of elastic yarns in side-by-side relation to the set of knitting needles.

6. A method of fabricating a band with an integrated drawcord according to claim 1, wherein the step of knitting a first set of yarns comprises feeding a set of elastic yarns in side-by-side relation to the set of knitting needles.

7. A method of fabricating a band with an integrated drawcord according to claim 4, wherein the step of feeding at least one filling yarn comprises feeding a pair of filling yarns to the set of knitting needles from opposing sides to appear at opposite sides of the finished band.

8. A method of fabricating a band with an integrated drawcord according to claim 1, wherein the step of knitting another yarn on the spaced pair of needles comprises feeding a pair of warp yarns respectively to the spaced pair of needles and simultaneously feeding a filling yarn transversely to each needle of the spaced pair of needles.

9. A method of fabricating a band with an integrated drawcord according to claim 5, wherein the step of knitting another yarn on the spaced pair of needles comprises feeding a pair of warp yarns respectively to the spaced pair of needles and simultaneously feeding a filling yarn transversely to each needle of the spaced pair of needles.

10. A knitted band with an integrated drawcord produced according to the method of claim 1.

11. A knitted band with an integrated drawcord produced according to the method of claim 9.

12. A composite band with an integrated drawcord comprising an elongate plain finished band of indeterminant length, a drawcord extending lengthwise along one face of the band, and at least one filling yarn and two warp yarns knitted to the plain finished band with the warp yarns being respectively knitted lengthwise to the band along opposite sides of the drawcord and the filling yarn traversing laterally back and forth outwardly across the drawcord and being knitted with the warp yarns for covering and capturing the drawcord in a tunnel area defined between the traversing filling yarn and the plain finished band.

* * * * *